US006166345A

United States Patent [19]

Ito et al.

[11] Patent Number: 6,166,345

[45] Date of Patent: Dec. 26, 2000

[54] SEE-SAW SWITCH

[75] Inventors: Ryoji Ito, Tsu; Yasunari Takedomi, Hisai, both of Japan

[73] Assignee: Matsushita Electric Works, Ltd., Kadoma, Japan

[21] Appl. No.: 09/251,469

[22] Filed: Feb. 17, 1999

[30] Foreign Application Priority Data

Feb. 24, 1998 [JP] Japan ..... 10-041845
Apr. 21, 1998 [JP] Japan ..... 10-111140

[51] Int. Cl.[7] ..... H01H 5/08

[52] U.S. Cl. ..... 200/437; 200/438; 200/439

[58] Field of Search ..... 200/437–439, 200/524, 341–344

[56] References Cited

FOREIGN PATENT DOCUMENTS 56-166623 5/1980 Japan .

*Primary Examiner*—Michael L. Gellner
*Assistant Examiner*—Nhung Nguyen
*Attorney, Agent, or Firm*—Arent Fox Kintner Plotkin & Kahn PLLC

[57] ABSTRACT

A see-saw switch capable of closing the contacts at a high initial contact pressure. The switch includes a housing provided with a fixed contact, and a lever provided with a movable contact at one longitudinal end thereof. The lever is pivotally supported to the housing for pivotal movement about a pivot axis between a contact closing position and a contact opening position. A plunger is slidably supported to the housing for linear movement along an axial direction of the plunger, and has an actuator which is held in slidable contact with said lever for translating the linear movement of the plunger into the pivotal movement of the lever so that, when the plunger moves in a forward direction, the actuator causes the lever to pivot about the pivot axis into the closed position. A restrictor is provided to keep the lever engaged with the plunger in order to restrict the lever from pivoting from the open position to the closed position until the actuator proceeds in the forward direction past a critical point which is offset from the pivot axis by a certain distance towards the movable contact along the lever. Thus, the lever operates to close the contacts only after the actuator past the critical point where it applies a sufficient force to the lever so as to impart the substantial initial contacting pressure between the contacts.

12 Claims, 10 Drawing Sheets

SEE-SAW SWITCH

BACKGROUND OF THE INVENTION

1. Field of the Invention

The present invention is directed to a see-saw switch, and more particularly, an electrical toggle switch having a see-saw lever which is actuated by a plunger to pivot for contact closing and opening.

2. Description of the Prior Art

Japanese Utility Model Laid-Open Publication No. 56-166623 discloses a known toggle see-saw switch. The see-saw switch includes a see-saw lever carrying a movable contact for closing with a complementary fixed contact mounted in a housing. The lever is pivotally supported to the housing and is actuated by a plunger to pivot about a pivot axis or fulcrum between a contact open position and a contact closing position. The plunger is slidably supported to the housing for linear movement along an axial direction of the plunger, and is formed at its one end with an actuator which is held in slidable contact with the lever for translating the linear movement of the plunger into the pivotal movement of the lever. This known switch is arranged such that, as soon as the actuator proceeds past the pivot axis along the length of the lever towards the movable contact, the actuator exerts a force to pivot the lever into the contact closing position. Thus, the movable contact will first come into engagement with the fixed contact at almost zero initial contacting pressure which incurs an elongated contact bouncing time with an associated long arcing time, and therefore brings about undesired contact wearing.

SUMMARY OF THE INVENTION

In view of the above problem, the present invention has been achieved to provide a see-saw switch which is capable of closing the contacts at a high initial contact pressure for reducing the contact bouncing time and minimizing the contact wearing. The see-saw switch of the present invention includes a housing provided with a fixed contact, and a lever provided with a movable contact at one longitudinal end thereof. The lever is pivotally supported to the housing for pivotal movement about a pivot axis between a closed position of engaging the movable contact with the fixed contact and an open position of disengaging the movable contact from the fixed contact. A plunger is slidably supported to the housing for linear movement along an axial direction of the plunger, and has an actuator which is held in slidable contact with said lever for translating the linear movement of the plunger into the pivotal movement of the lever so that, when the plunger moves in a forward direction, the actuator causes the lever to pivot about the pivot axis into the closed position. The important feature of the present invention resides in that a restrictor is provided to keep the lever engaged with the plunger in order to restrict the lever from pivoting from the open position to the closed position until the actuator proceeds in the forward direction past a critical point which is offset from the pivot axis by a certain distance towards the movable contact along the lever, and to release the lever from the plunger immediately after the actuator proceeds past the critical point in the forward direction, permitting the lever to pivot to the closed position for contact closure with a substantial contact pressure between the movable and fixed contacts. With the provision of the restrictor, the lever operates to close the contacts only after the actuator past the critical point where it applies a sufficient force to the lever so as to impart the substantial initial contacting pressure between the contacts. Thus, the movable contact can close on the fixed contact without causing undesired contact bouncing and the associated contact arcing over a long time, thereby minimizing the contact wearing.

Accordingly, it is a primary object of the present invention to provide a see-saw switch which is capable of minimizing the contact wearing for prolonged operation life.

Preferably, the restrictor is realized by a stopper which projects from one longitudinal end of the lever opposite of the movable contact to be engageable with a catch portion of the plunger behind the actuator with respect to the forward direction. The stopper is kept engaged with the catch portion of the plunger while the actuator proceeds from the pivot axis to the critical point along the lever and is disengaged from the catch portion after the actuator proceeds past the critical point, thereby allowing the lever to pivot into the contact closed position.

The housing includes a terminal member which projects out of the housing for electrical connection of the movable contact to an external circuit. The upper end of the terminal member located in the housing is configured to pivotally support the lever thereon.

The switch may be of a multi-pole type having the single plunger and a pair of first and second contact mechanisms each including the fixed contact, the lever with the movable contact and the stopper, and the actuator. The plunger is urged by a return spring in a rearward direction of opening the contacts. The stoppers of the first and second contact mechanisms are arranged to come into engagement with the corresponding catch portions of the plunger in a delayed fashion as the plunger moves in the rearward direction, whereby the rearward moving plunger operates to forcibly pivot the one lever first into the open position and subsequently pivot the other lever into the open position. With this arrangement, the force of the return spring can be concentrated to the one of the levers in order to disengage the movable contact and is therefore effective to forcibly separate the movable contact if it is welded to fixed contact. Even if the other movable contact is also welded, the force of the return force can be also concentrated to separate the other movable contact as the one movable contact has been separated from the corresponding fixed contact at this time.

Accordingly, it is a further object of the present invention to provide a see-saw switch which is capable of concentrating the force of the return spring to successfully separate the individual movable contacts one by one for improved contacting performance free from contact welding.

In a preferred version of the present invention, the above delayed engagement is realized by an offset arrangement of the individual catch portions of the plunger with respect to the axial direction thereof while using the levers of identical configuration. The individual actuators of the plunger are disposed at the same position with respect to the axial direction of the plunger, while the individual levers are pivotally supported at different points with respect to the axial direction so that the critical points of the individual levers are offset from the corresponding pivot axis by the same amount. Thus, it is made to effect the above delayed engagement of the plunger with the individual levers for forcibly pivoting the levers one by one into the open position, yet assuring to give the same initial contacting pressure to the individual levers when pivoting the levers into the contact closing position.

Alternately, the above delayed engagement may be attained by using the levers of which stoppers are offset with respect to the axial direction of the plunger, while retaining the individual levers to be pivotally supported at the same position as well as the individual catch portions at the same position with respect to the axial direction of the plunger.

Other various advantageous schemes are also disclosed and claimed in the present invention to achieve the above delayed engagement of the plunger with the one lever and subsequently with the other lever by the use of the individual levers of the same or different configuration.

These and still other objects and advantages will become more apparent from the following detailed description of the embodiment and modifications thereof when taken in conjunction with the attached drawings.

BRIEF DESCRIPTION OF THE DRAWINGS

FIGS. 11A to 15A and 11B to 15B are diagrams illustrating other schemes of separating the contacts in a delayed manner.

DETAILED DESCRIPTION OF THE EMBODIMENT

Figure 1:
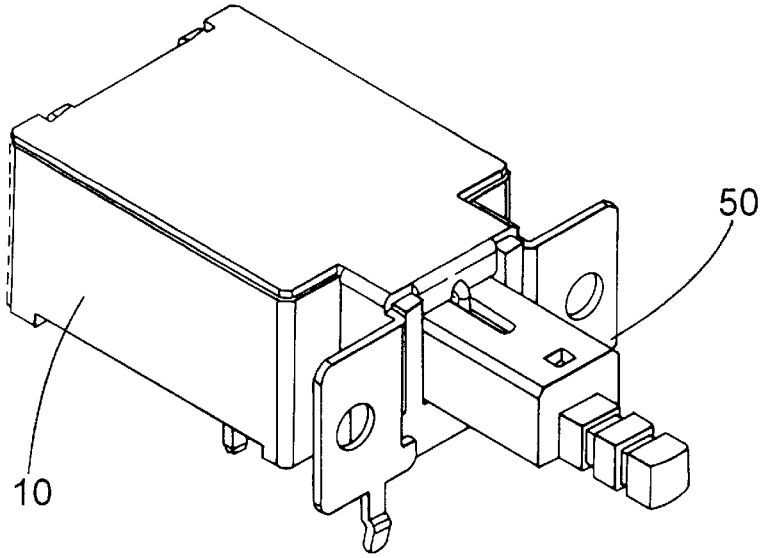
FIG. 1 is a perspective view of a see-saw switch in accordance with a preferred embodiment of the present invention.
Figure 2:
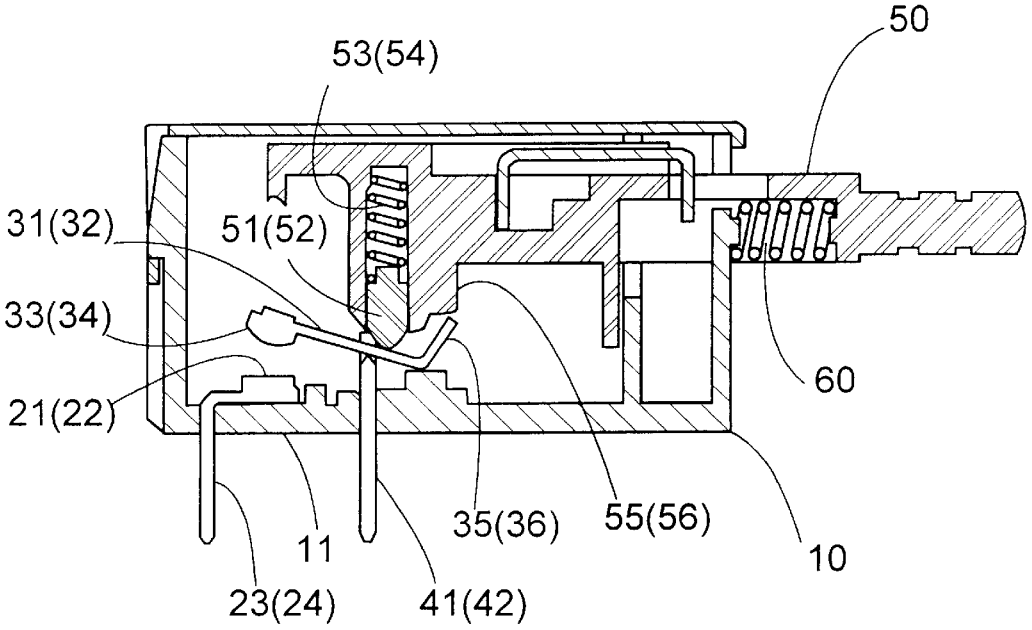
FIG. 2 is a sectional view of the see-saw switch.
Figure 3:
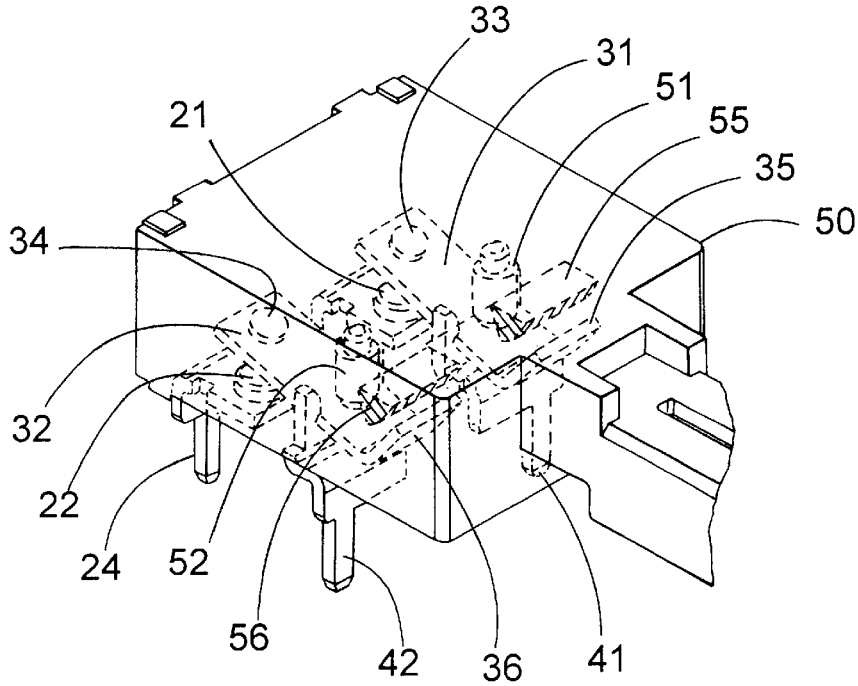
FIG. 3 is a partial perspective view illustrating a pair of levers with associated contacts and a plunger of the switch.
Figure 4:
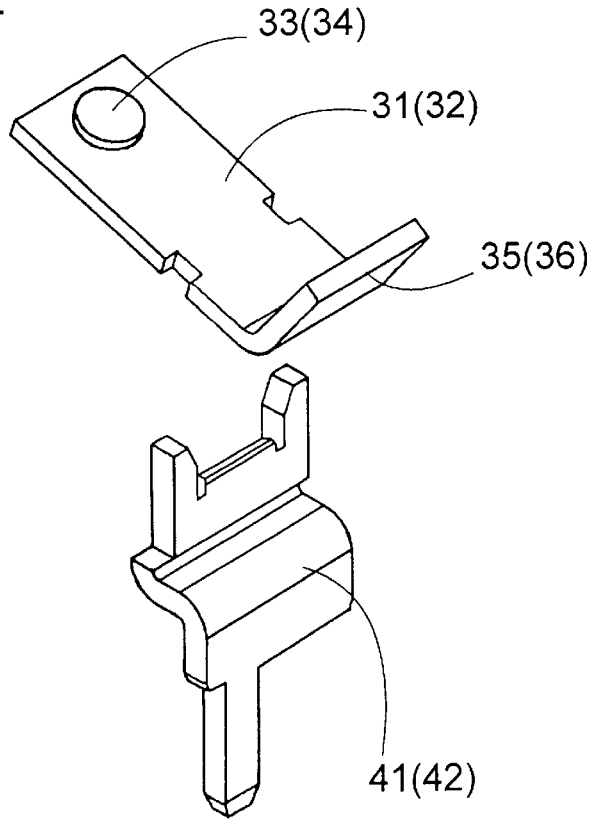
FIG. 4 is an exploded perspective view of the lever and a corresponding terminal lead.

Referring to FIGS. 1 to 3, there is shown a see-saw switch in accordance with a preferred embodiment of the present invention. The switch is adapted in use as a latch-in type electrical power switch for a television set or the like electrical device, and is configured as a multi-pole switch having at least two contact sets for connection with an external circuit. The switch has a housing 10 which incorporates a pair of pivotable levers 31 and 32 each of which carries a movable contact 33, 34 at one lengthwise end of the lever for closing and opening to and from a complementary fixed contact 21, 22 mounted within the housing 10. The housing 10 includes a base 11 through which two pairs of terminal leads 41, 42 and 23, 24 project for electrical connection of the movable and fixed contacts respectively with the external circuit. The terminal leads 41 and 42 are each formed at its one end with a knife edge or a like pivot structure so as to pivotally support the lever 31, 32 for permitting the lever to pivot about a pivot axis between a contact closing position and a contact opening position. As shown in FIG. 4, the lever 31, 32 is retained on the upper end of the terminal lead 41, 42 in a known manner so as to effect the pivotal movement.

The levers 31 and 32 are operatively connected to a single plunger 50 and driven thereby to close and open the contacts. The plunger 50 is slidably supported to the housing 10 for linear movement along an axial direction of the plunger. Formed at the front end of the plunger 50 are a pair of first and second actuators 51 and 52 which are held in slidable contact respectively with the levers 31 and 32 so as to translate the linear movement of the plunger 50 into the pivotal movement of the levers. For this purpose, each actuator 51, 52 is biased by a spring 53, 54 to abut constantly against the lever. The plunger 50 is urged by a return spring 60 in a rearward direction of pivoting the levers 31 and 32 into the contact opening position, which is a normal position of the lever, as shown in FIG. 2. The return spring 60 is disposed between one end wall of the housing 10 and a rear operator end of the plunger 50. Thus, the contact closing is made by pushing the plunger 50 in a forward direction against the return spring 60 during which each actuator 51, 52 proceeds past the corresponding pivot axis to pivot each lever 31, 32 into the contact closing position.

Figure 5:
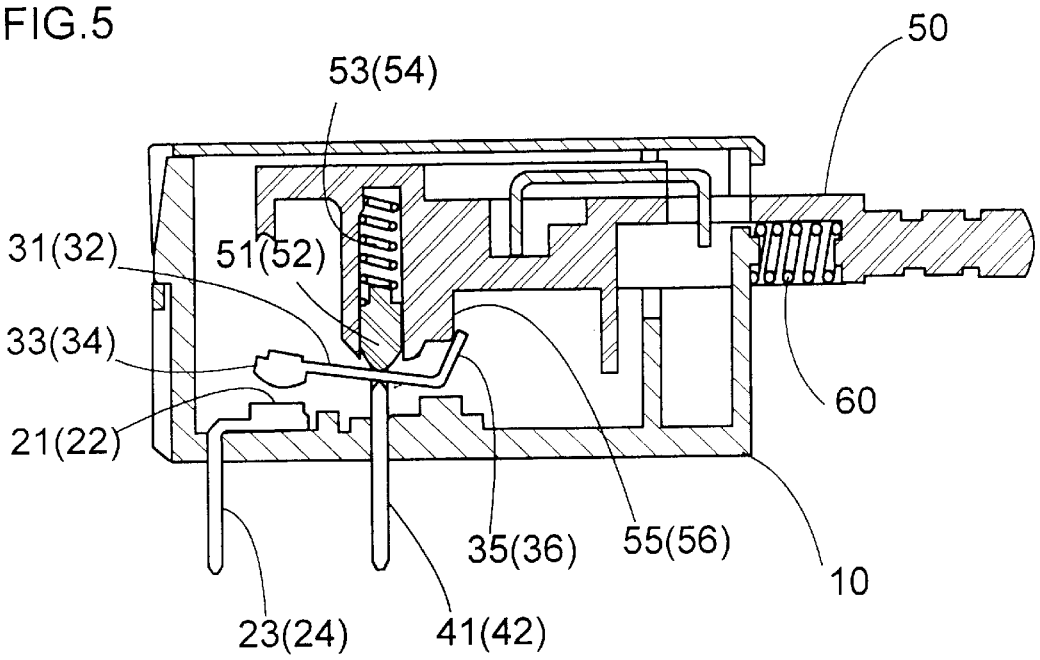
FIGS. 5 to 7 are sectional views of the see-saw switch with the lever shown in the varying positions.
Figure 6:
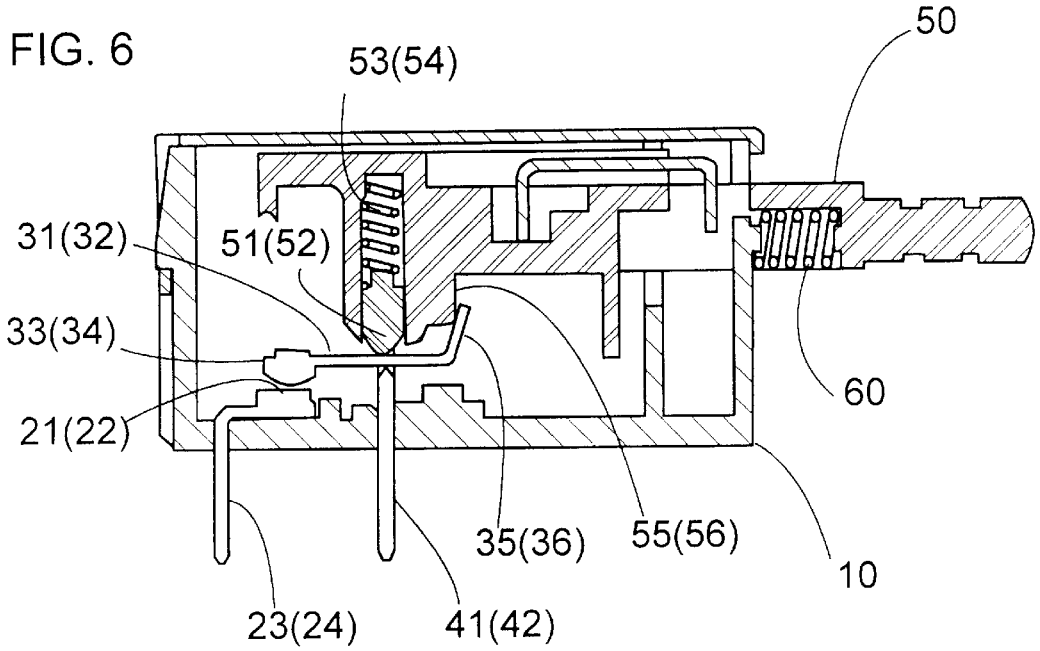
Figure 7:
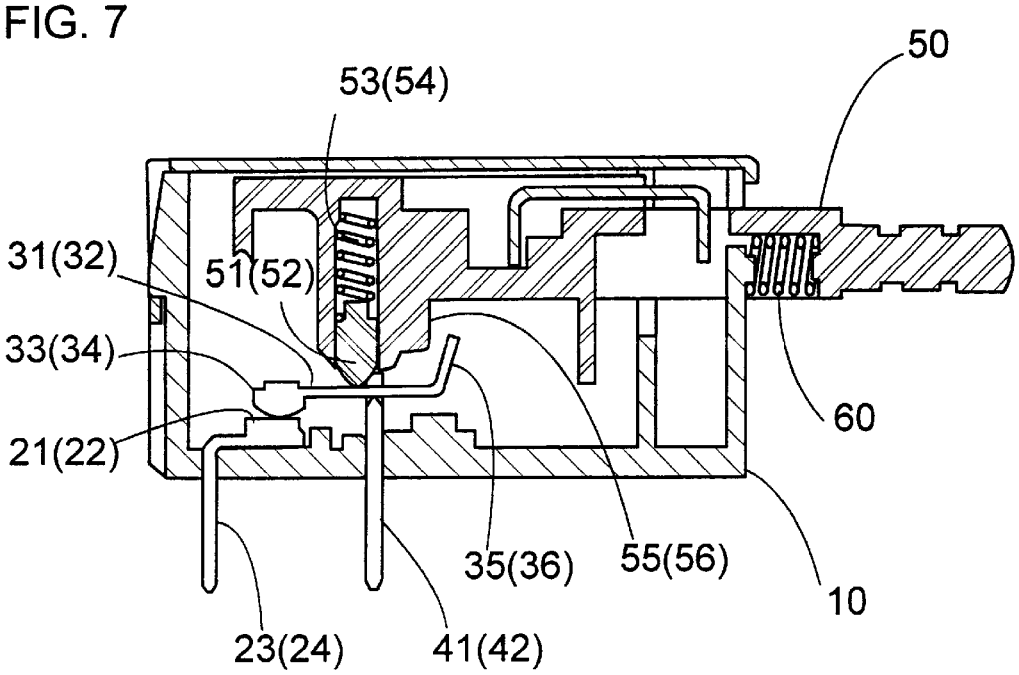
Figure 8:
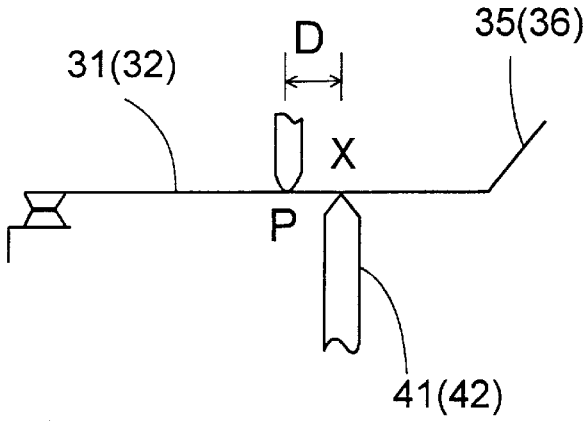
FIG. 8 is a schematic view illustrating the operation of the switch.
Figure 9:
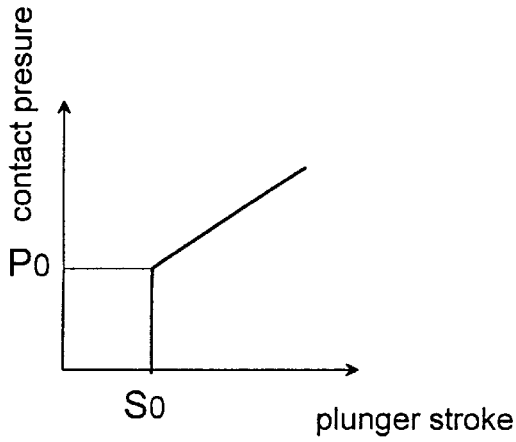
FIG. 9 is a diagram illustrating the operation of the switch.

Each lever 31, 32 is formed at its one end opposite of the movable contact 33, 34 with a stopper 35, 36 which projects at an angle for engageable relation to each one of catch portions 55 and 56 formed on the plunger 50 behind the actuators 51 and 52. One of ordinary skill in the art would appreciate that the stopper 35, 36 and the catch portions 55, 56 form a restrictor means. When the plunger 50 is pushed in the forward direction, each stopper 35, 36 is first to come into latching engagement with the corresponding catch portion 55, 56 as soon as the corresponding actuator 51, 52 proceed past the pivot axis, thereby restraining the lever 31, 32 from pivoting further into the contact closing position, as shown in FIG. 5. Each lever 31, 32 is kept in the contact closing position until the corresponding actuator 51, 52 proceeds in the forward direction past a critical point P which is offset from the pivot axis X by a distance D along the length of the lever, as shown in FIGS. 6 and 8. For example, the distance D is selected to be 0.7 mm when the length from the pivot point X to the movable contact is 4.5 mm. Immediately after the actuator 51, 52 further proceeds past the critical point P, the stopper 35, 36 is released from the catch portion 55, 56 of the forwardly moving plunger 50, permitting the lever 31, 32 to pivot for closing the contacts, as shown in FIG. 7. In this manner, the contact closing is made only after the actuator 51, 52 proceeds past the critical point P offset from the pivot axis X towards the movable contact 33, 34 where the actuator 51, 52 exerts a force to the lever with a sufficient mechanical advantage. Therefore, the movable contact 33, 34 can be closed on the fixed contact 21, 22 at a sufficient initial contact pressure P0, as shown in FIG. 9, assuring to make a reliable contact closing free from contact bounding. As the plunger 50 is further pushed to move the actuator 51, 52 along the lever 31, 32, the actuator gives a correspondingly increased contact pressure, as indicated in FIG. 9. A latch-in mechanism is included to latch the plunger 50 or the levers 31 and 32 in the contact closing position after pushing in the plunger 50. The latch-in mechanism may be of a known structure composed of a so-called heart-shaped cam groove formed in the plunger and a follower pin supported to the housing 10.

Upon further pushing in the plunger 50, the plunger 50 is unlatched to move in the rearward direction by the bias of the return spring 60 for contact opening. As the actuator 51, 52 moves backwards past the critical point, the catch portion 55, 56 gives an impact to the stopper 35, 36 for forcibly pivoting the lever 31, 32 into the contact opening position, thereby making a rapid contact separation. With this thrust, given by the return spring 60, the movable contact 33, 34 if welded to the fixed contact can be successfully separated therefrom. After the actuator 51, 52 proceeds past the pivot axis or point X in the rearward direction, the lever 31, 32 is caused to pivot to and is kept in the normal contact opening position of FIG. 2.

Figure 10A:
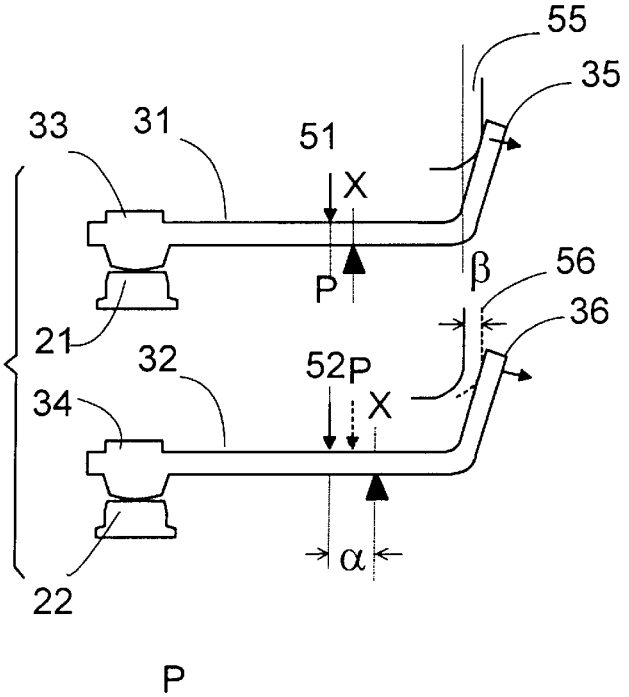
FIGS. 10A and 10B are schematic views illustrating one scheme of separating the two contacts in a delayed manner.
Figure 10B:
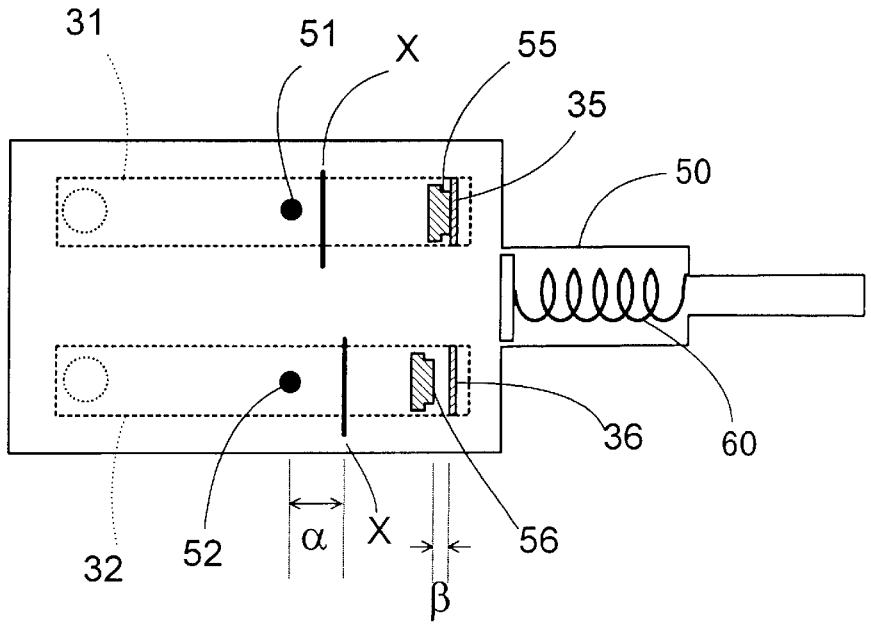

When the plunger 50 moves in the rearward direction from the position of FIG. 7, the stoppers 35 and 36 of the individual levers 31 and 32 are made to come into engagement with corresponding catch portions 55 and 56 in a delayed fashion so that the forced contact separation occurs first to the one lever 31 and subsequently to the other lever 32. FIGS. 10A and 10B show one scheme of realizing the delayed contact separation with the use of the two levers 31 and 32 of the identical configurations with the respective stoppers 35 and 36. These two levers 31 and 32 are pivotally supported at different positions along the axial direction of the plunger, one lever 31 shown at the upper part of FIGS. 10A and 10B to have a pivot axis or point X offset towards the movable contact 33 from that of the other lever 32 shown in the lower part of the figures. Although not shown in FIGS. 10A and 10B, it is noted that the terminal leads 41 and 42 defining the pivot points respectively at their respective upper ends are configured to have their lower ends aligned in a direction perpendicular to the axial direction of the plunger in order to eliminate the necessity of providing a special configuration for a printed board or the like that receives the terminal leads.

For the purpose of easily comprehending the operation of the delayed contact separation, the two levers 31 and 32 are referred hereinafter to as the first and second levers which are respectively shown in the upper and lower parts of the figures. Likewise, the two stoppers 35, 36, and the two pivot points of the levers 31,32, as well as the two actuators 51, 52 and the two catch portions 55, 56 of the plunger 50 are referred to as first and second ones, respectively. The first and second actuators 51 and 52 (indicated by arrows in FIG. 10A) of the plunger 50 are disposed at the same position with respect to the axial direction of the plunger but offset from the corresponding pivot points X by differing amounts so as to give the same initial contacting pressure for the first and second levers 31 and 32 when closing the contacts, while the first and second levers 31 and 32 effect the contact closing with a corresponding delay. Further, the first and second catch portions 55 and 56 are offset along the axial direction of the plunger 50 so that, as the plunger moves in the rearward direction, the first catch portion 55 comes first into engagement with the first stopper 35 and subsequently the second catch portion 56 comes into engagement with the second stopper 36. Thus, the first lever 31 is caused to pivot to forcibly separate the movable contact 33 from the fixed contact 21 while the second lever 32 is still in the contact closing position. Then, the second lever 32 is caused to pivot to forcibly separate the associated movable contact 34 from the fixed contact 22. In order to achieve the above forced separation of the movable contacts one by one, while assuring to give the high initial contacting pressure to both of the first and second levers 31 and 32, following two conditions are to be satisfied.

1) As the first and second actuators 51 and 52 move in the forward direction from the corresponding pivot points X to the critical points P, the first and second stoppers 35 and 36 should be kept in engagement with the first and second catch portions 55 and 56, respectively to restrain the first and second levers 31 and 32 from pivoting into the contact closing position; and 2) When the first catch portion 55 comes into engagement with the first stopper 35 in the rearward movement of the plunger 50 to give the corresponding impact of forcibly separating the associated contacts, the second catch portion 56 should be kept disengaged from the second stopper 36 to give no such impact of separating the associated contacts. These two conditions are met by establishing a relation $\alpha>\beta$ where $\alpha$ is a distance between the pivot point X of the second lever 32 and the position of the second actuator 52 at the time of the first actuator 51 proceeds to the critical point P of the first lever 31, and $\beta$ is a displacement required for the plunger 50 to move in the rearward direction from an initial point of engaging the first catch portion 55 with the first stopper 35 to an initial point of engaging the second catch portion 56 with the second stopper 36. Consequently, the bias of the return spring 60 can be concentrated to forcibly pivot either of the first and second levers into the contact opening position, facilitating to break the contact welding if occurred.

Figure 11A:
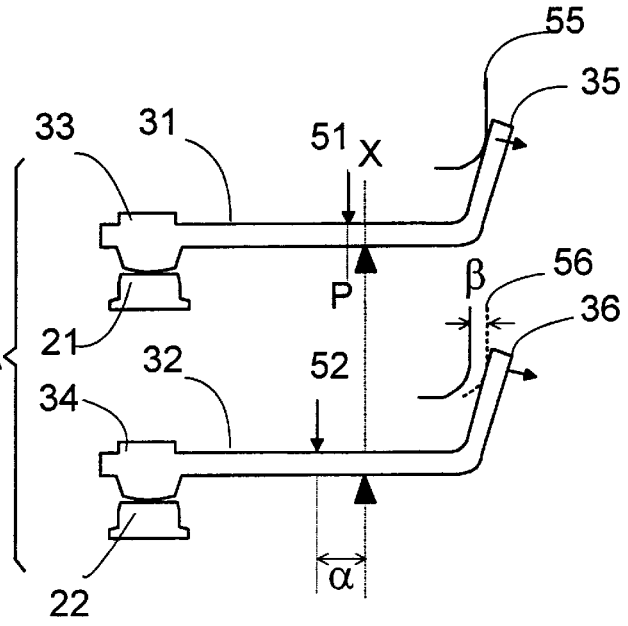
Figure 11B:
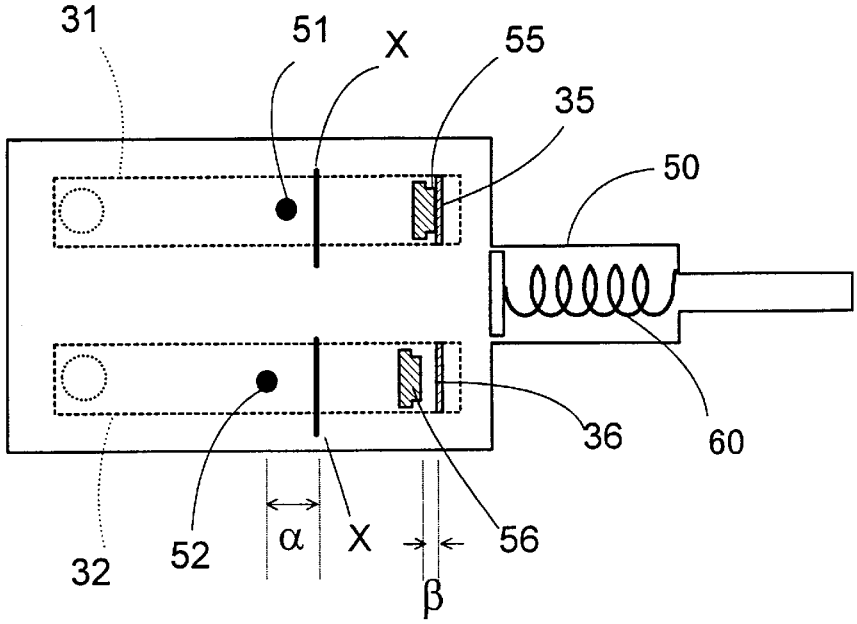

To enable the above delayed contact separation while giving the high initial contacting pressures, following modifications are equally applicable for the present invention. FIGS. 11A and 11B show one modification in which the first and second levers 31 and 32 of identical configuration are employed together with the plunger 50 having the first and second catch portions 55 and 56 which are offset from each other in the axial direction of the plunger. The first and second levers 31 and 32 have the same pivot point X in the axial direction of the plunger 50, while the actuators 51 and 52 are offset from each other in the axial direction to satisfy the above relation $\alpha>\beta$.

Figure 12A:
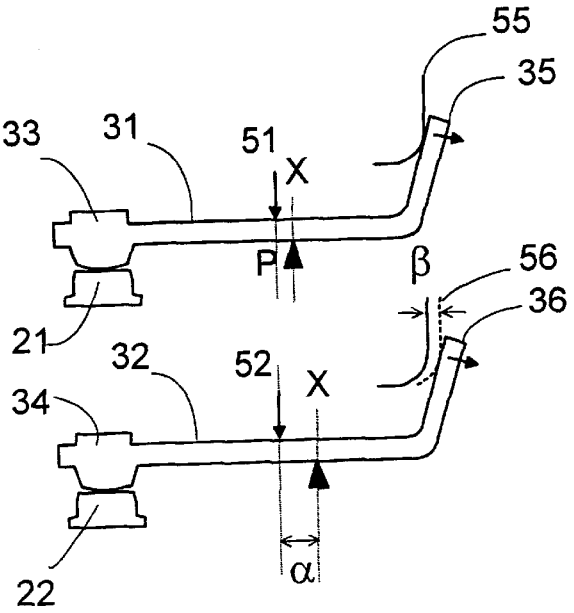
Figure 12B:
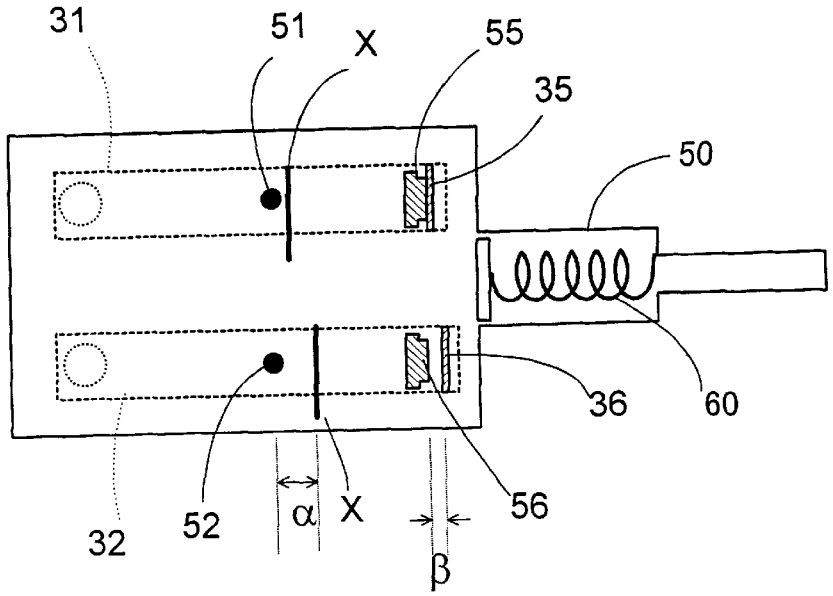

FIGS. 12A and 12B show another modification in which the first and second levers 31 and 32 of the identical configuration are employed in combination with the plunger 50 having the first and second catch portions 55 and 56 at the same position and having the first and second actuators 51 and 52 at the same position along the axial direction of the plunger 50. The first and second levers 31 and 32 are pivotally supported at differing points X along the axial direction to satisfy the above relation $\alpha>\beta$.

Figure 13A:
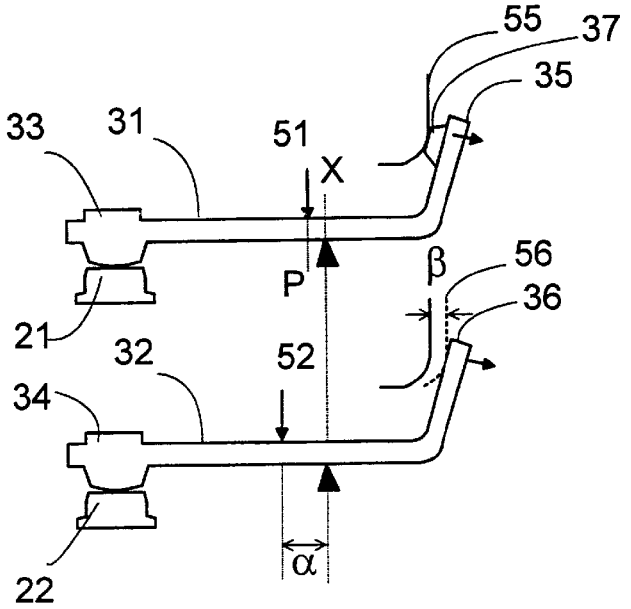
Figure 13B:
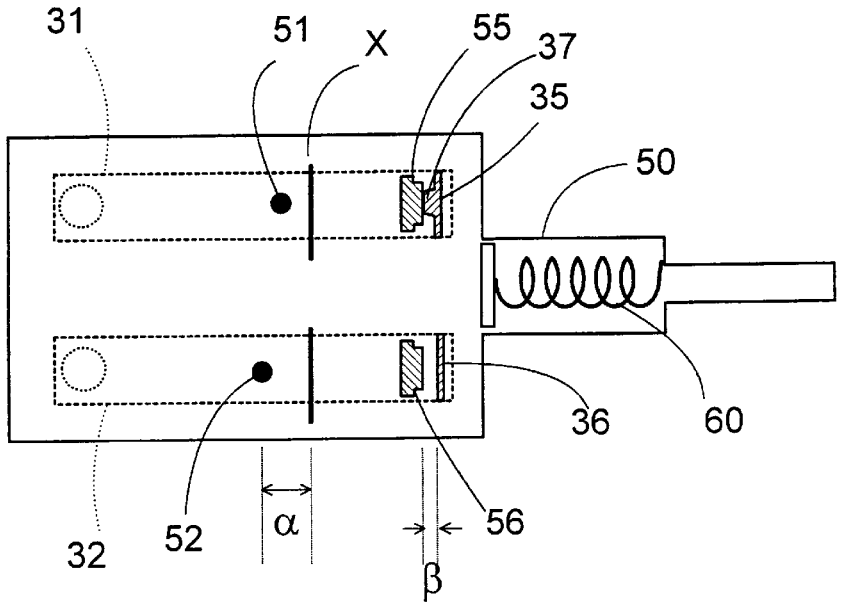

FIGS. 13A and 13B show a further modification which employs the first and second levers 31 and 32 which are identical except that the first stopper 35 is additionally formed with a pad 37 for engagement with the first catch portion 55. The first and second levers 31 and 32 are pivotally supported at the same point X. The plunger 50 has the first and second catch portions 55 and 56 at the same position but has the first and second actuators 51 and 52 at the differing positions along the axial direction of the plunger 50 in order to satisfy the above relation $\alpha>\beta$. That is, the first actuator 51 is made closer to the common pivot axis X than the second actuator 52 when the first actuator 51 comes to the critical point P where the first catch portion 55 first engages with the pad 37 of the first stopper 35 during the rearward movement of the plunger 50.

Figure 14A:
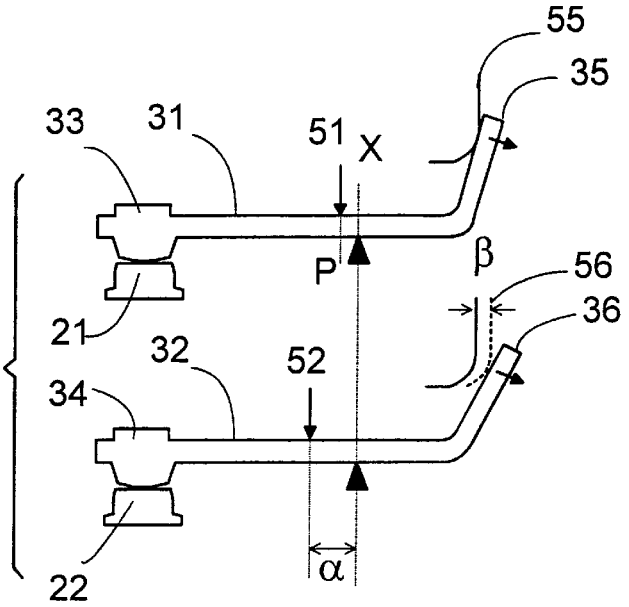
Figure 14B:
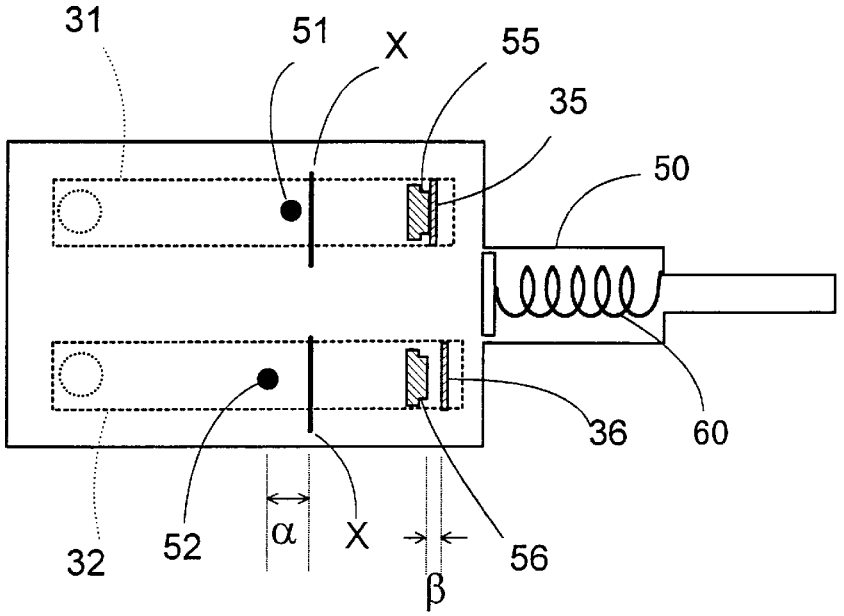

FIGS. 14A and 14B show a further modification which employs the first and second levers 31 and 32 having the first and second stoppers 35 and 36 extending at different angles with respect to the axial direction of the plunger 50 so as to make the second stopper 36 offset from the first stopper 35 in the axial direction. The first and second levers 31 and 32 are pivotally supported at the same points X along the axial direction. The plunger 50 has the first and second catch portions 54 at the same positions, but has the first and second actuators 51 and 52 at differing positions along the axial direction to satisfy the above relation $\alpha>\beta$.

Figure 15A:
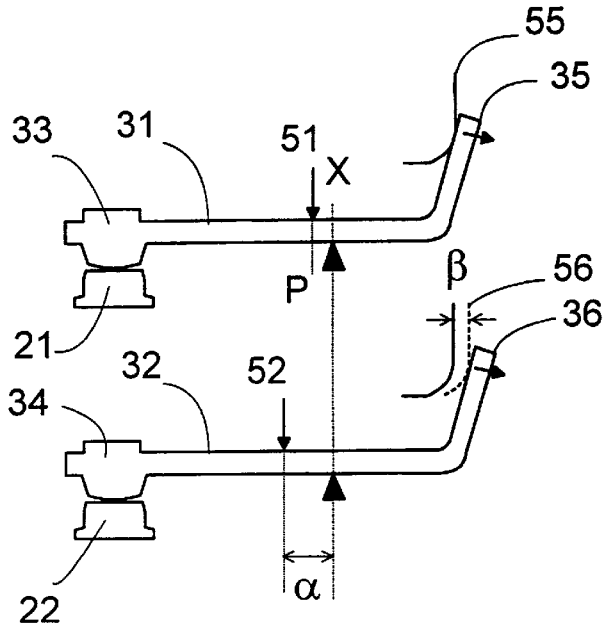
Figure 15B:
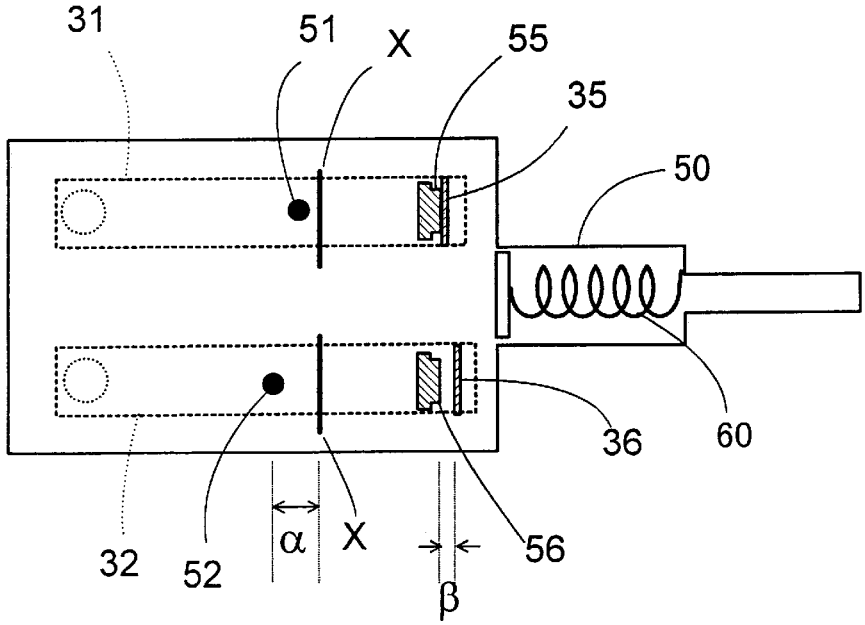

FIGS. 15A and 15B show a still further modification in which the first and second levers 31 and 32 of different lengths are employed in combination with the plunger 50 having the first and second catch portions 55 and 56 at the same positions and having the first and second actuators 51 and 52 at differing positions along the axial direction of the plunger. The first and second levers 31 and 32 are pivotally supported at the same points X along the axial direction of the plunger with the second stopper 36 being offset rearwards from the first stopper 35 in the axial direction. In this modification, the above relation $\alpha>\beta$ is maintained.

It should be noted in this connection that the feature of the present invention can be accomplished in any suitable combination of the individual structural arrangement disclosed hereinbefore with regard to the positions of the first and second stoppers, the positions of the first and second catch portions, the pivots points of the first and second levers.

What is claimed is:

1. A see-saw switch comprising:

a housing provided with a fixed contact;

a lever provided with a movable contact at one longitudinal end thereof, said lever being pivotally supported to said housing for pivotal movement about a pivot axis between a closed position of engaging said movable contact with said fixed contact and an open position of disengaging said movable contact from said fixed contact;

a plunger slidably supported to said housing for linear movement along an axial direction of said plunger;

an actuator operative in conjunction with said plunger and held in slidable contact with said lever for translating said linear movement of said plunger into the pivotal movement of said lever so that, when said plunger moves in a forward direction, the actuator is movable in a forward direction along the lever and causes said lever to pivot about said pivot axis to said closed position; and restrictor means for keeping said lever engaged with said plunger in order to restrict said lever from pivoting from said open position to said closed position until said actuator proceeds in said forward direction past a critical point which is offset from said pivot axis by a certain distance towards said movable contact along said lever, and for releasing said lever from said plunger immediately after said actuator proceeds past said critical point in said forward direction, permitting said lever to pivot into said closed position for contact closing with a substantial contact pressure between said movable and fixed contacts.

2. The see-saw switch as set forth in claim 1, wherein said restrictor means comprises a stopper projecting from one longitudinal end of said lever opposite of said movable contact and a catch portion of said plunger behind said actuator with respect to said forward direction engageable by said stopper, said stopper being kept engaged with said catch portion of said plunger while said actuator proceeds from said pivot axis to said critical point along said lever in said forward direction.

3. The see-saw switch as set forth in claim 1, wherein said housing carries a terminal lead projecting out of said housing for electrical connection of said movable contact to an external circuit, said terminal lead having an upper end which is located within the housing and configured to pivotally support said lever thereon.

4. The see-saw switch as set forth in claim 2, wherein said switch is of a multi-pole type having single said plunger and first and second contact mechanisms each comprising said fixed contact, said lever with said movable contact and said stopper, and said actuator, said plunger being urged by a return spring to move in a rearward direction of opening said movable contacts from the associated fixed contacts, and said stoppers of the first and second contact mechanisms being arranged to come into engagement with the corresponding catch portions of said plunger in a delayed fashion as said plunger moves in said rearward direction, whereby said rearward moving plunger operates to forcibly pivot the one lever first into the open position and subsequently pivot the other lever into the open position.

5. The see-saw switch as set forth in claim 4, wherein said individual levers are of the identical structure having the same length and the same stoppers, said individual catch portions of said plunger being offset from each other with respect to the axial direction of said plunger, said individual actuators of the plunger being disposed at the same position with respect to said axial direction of the plunger, and said individual levers being pivotally supported at different points with respect to said axial direction so that said critical points of the individual levers are offset from the corresponding pivot axes by the same amount.

6. The see-saw switch as set forth in claim 4, wherein said individual levers are of the identical structure having the same length and the same stoppers, said individual catch portions of said plunger being offset from each other with respect to the axial direction of said plunger, said individual levers being pivotally supported at the same points with respect to the axial direction of said plunger, and said individual actuators of the plunger being offset from each other with respect to the axial direction of said plunger.

7. The see-saw switch as set forth in claim 4, wherein said individual levers are of the identical structure having the same length and the same stoppers, said individual catch portions of said plunger being disposed at the same position with respect to the axial direction of said plunger, said individual actuators of said plunger being disposed at the same position with respect to said axial direction, and said individual levers being pivotally supported at different points with respect to said axial direction.

8. The see-saw switch as set forth in claim 7, wherein said levers are pivotally supported respectively to upper ends of separate terminal leads mounted to said housing, the upper ends of said terminal leads defining said individual pivot axes which are offset from each other with respect to the axial direction of said plunger while the lower ends of said terminal leads are aligned in a direction perpendicular to said axial direction of said plunger.

9. The see-saw switch as set forth in claim 4, wherein said individual levers are of the identical structure having the same length and the same stoppers, said individual levers being pivotally supported at the same points with respect to the axial direction of said plunger, said individual catch portions of said plunger being disposed at the same position with respect to said axial direction, only one of said stopper being formed with a pad which engages with the corresponding catch portion of said plunger when said plunger moves in the rearward direction, and said individual actuators of the plunger being offset from each other with respect to the axial direction of said plunger such that the actuator associated with the lever provided with said pad is disposed at a position closer to the corresponding pivot point than the other actuator when said pad engages first with said catch portion.

10. The see-saw switch as set forth in claim 4, wherein said individual stoppers of said levers are offset from each other with respect to said axial direction of the plunger, said levers being pivotally supported at the same position with respect to said axial direction, said individual catch portions of said plunger being disposed at the same position with respect to said axial direction, and said individual actuators of the plunger being offset from each other with respect to the axial direction of said plunger.

11. The see-saw switch as set forth in claim 10, wherein the individual levers have said respective stoppers which project from the one longitudinal ends of said levers opposite of said movable contacts at differing angles with respect to the length of said levers.

12. A see-saw switch comprising:

a housing provided with a pair of fixed contacts;

a pair of levers each provided with a movable contact at one longitudinal end thereof, each lever being pivotally supported to said housing for pivotal movement about a pivot axis between a contact closing position and a contact opening position, each of said levers being provided with a stopper which projects from its longitudinal end opposite of said movable contact; and a single plunger slidably supported to said housing for linear movement along an axial direction of said plunger, said plunger having a pair of actuators each of which is held in slidable contact with each of said levers for translating said linear movement of said plunger into the pivotal movement of said lever so that, when said plunger moves in a forward direction, the actuator causes said lever to pivot about said pivot axis to said closed position, said plunger being urged by a return spring to move in a rearward direction of opening said movable contacts from the associated fixed contacts, and said plunger being formed with a pair of catch portions which are disposed respectively behind said actuators with respect to said forward direction to be engageable respectively with said stoppers;

wherein said stoppers are arranged to come into engagement with the corresponding catch portions of said plunger in a delayed fashion as said plunger moves in said rearward direction, whereby said rearward moving plunger operates to forcibly pivot the one lever first into the open position and subsequently pivot the other lever into the open position.

* * * * *